US010569122B2

(12) United States Patent
Johnson

(10) Patent No.: US 10,569,122 B2
(45) Date of Patent: Feb. 25, 2020

(54) ATTACHABLE ROTARY RANGE OF MOTION REHABILITATION APPARATUS

(71) Applicant: Brainchild Medical, Inc., St. Louis, MO (US)

(72) Inventor: Kenneth Johnson, Los Angeles, CA (US)

(73) Assignee: Hurford Global, LLC, Edwardsville, IL (US)

( * ) Notice: Subject to any disclaimer, the term of this patent is extended or adjusted under 35 U.S.C. 154(b) by 0 days.

(21) Appl. No.: 15/331,267

(22) Filed: Oct. 21, 2016

(65) Prior Publication Data

US 2017/0113092 A1 Apr. 27, 2017

Related U.S. Application Data

(60) Provisional application No. 62/244,190, filed on Oct. 21, 2015.

(51) Int. Cl.
*A63B 21/00* (2006.01)
*A63B 22/00* (2006.01)
(Continued)

(52) U.S. Cl.
CPC ..... *A63B 22/0015* (2013.01); *A61H 1/0214* (2013.01); *A61H 1/0237* (2013.01);
(Continued)

(58) Field of Classification Search
None
See application file for complete search history.

(56) References Cited

U.S. PATENT DOCUMENTS 610,157 A 8/1898 Campbelle
4,446,753 A 5/1984 Nagano
(Continued)

FOREIGN PATENT DOCUMENTS

DE 8519150.7 10/1985
DE 3732905 7/1988
(Continued)

OTHER PUBLICATIONS

"ROM3 Rehab System" uploaded by ROM3 Rehab, Apr. 20, 2015. https://vimeo.com/125438463.*
(Continued)

*Primary Examiner* — Gary D Urbiel Goldner
(74) *Attorney, Agent, or Firm* — Nyemaster Goode, PC

(57) ABSTRACT

An exercise and rehabilitation apparatus for exercising an extremity of a user. The apparatus includes a flywheel having a first side and a second side with a channel in the first side. The channel has a top edge near a planer surface of the first side. A lever, such as a pedal or handle, is adjustable in position and combined with an adjustment member. The adjustment member is movable within the channel between first and second positions. However, the adjustment member cannot be removed from the channel through a slot along the top edge. A locking pin, biased in an extended position, is combined with the adjustment member and is movable between the extended position and a retracted position. The flywheel includes a plurality of openings adapted to receive the locking pin in the extended position in order to secure the adjustment member at a particular location within the channel.

19 Claims, 11 Drawing Sheets

(51) Int. Cl.

| | |
|---|---|
| ***A61H 1/02*** | (2006.01) |
| ***A63B 22/06*** | (2006.01) |
| ***A63B 21/22*** | (2006.01) |
| ***A63B 23/04*** | (2006.01) |
| ***A63B 21/015*** | (2006.01) |

(52) U.S. Cl.

CPC ..... *A61H 1/0274* (2013.01); *A63B 21/225* (2013.01); *A63B 21/4034* (2015.10); *A63B 22/0046* (2013.01); *A63B 22/0605* (2013.01); *A63B 22/0694* (2013.01); *A63B 23/0476* (2013.01); *A61H 2201/0161* (2013.01); *A61H 2201/0192* (2013.01); *A61H 2201/164* (2013.01); *A61H 2201/1635* (2013.01); *A63B 21/00178* (2013.01); *A63B 21/00181* (2013.01); *A63B 21/015* (2013.01); *A63B 22/0005* (2015.10); *A63B 22/0007* (2013.01); *A63B 2022/0623* (2013.01); *A63B 2022/0652* (2013.01)

(56) References Cited

U.S. PATENT DOCUMENTS

| | | | | | |
|---|---|---|---|---|---|
| 4,509,742 | A * | 4/1985 | Cones | A63B 22/001 | 138/45 |
| 4,606,241 | A | 8/1986 | Fredriksson | | |
| 4,611,807 | A * | 9/1986 | Castillo | A63B 21/0125 | 482/119 |
| 4,850,245 | A | 7/1989 | Feamster et al. | | |
| 4,858,942 | A | 8/1989 | Rodriquez | | |
| 5,161,430 | A | 11/1992 | Febey | | |
| D342,299 | S | 12/1993 | Birrell et al. | | |
| 5,274,853 | A | 1/1994 | Dalebout | | |
| 5,316,532 | A * | 5/1994 | Butler | A63B 71/0009 | 482/111 |
| 5,338,272 | A | 8/1994 | Sweeney | | |
| 5,361,649 | A | 11/1994 | Slocum | | |
| 5,458,022 | A | 10/1995 | Mattfeld et al. | | |
| 5,580,338 | A | 12/1996 | Scelta et al. | | |
| 5,685,804 | A * | 11/1997 | Whan-Tong | A63B 22/001 | 482/51 |
| 5,860,941 | A | 1/1999 | Saringer et al. | | |
| 6,053,847 | A | 4/2000 | Stearns et al. | | |
| 6,155,958 | A | 12/2000 | Goldberg | | |
| 6,253,638 | B1 | 7/2001 | Bermudez | | |
| 6,543,309 | B2 | 4/2003 | Heim | | |
| 6,589,139 | B1 * | 7/2003 | Butterworth | B62M 3/02 | 482/57 |
| 6,865,969 | B2 | 3/2005 | Stevens | | |
| 7,226,394 | B2 | 6/2007 | Johnson | | |
| 7,594,879 | B2 * | 9/2009 | Johnson | A63B 22/0002 | 482/57 |
| 9,480,873 | B2 * | 11/2016 | Chuang | A63B 22/0015 | |
| 2005/0085353 | A1 | 4/2005 | Johnson | | |
| 2006/0019802 | A1 | 1/2006 | Caird | | |
| 2008/0161166 | A1 | 7/2008 | Lo | | |
| 2009/0211395 | A1 | 8/2009 | Mul'e | | |
| 2017/0113092 | A1 * | 4/2017 | Johnson | A63B 22/0046 | |

FOREIGN PATENT DOCUMENTS

| | | |
|---|---|---|
| DE | 19947926 | 4/2001 |
| EP | 1034817 | 9/2000 |

OTHER PUBLICATIONS

PCT/US16/58187 Written Opinion of the International Search Report dated Jan. 23, 2017.

SNS Care Co., LTD—User Manual—Apr. 15, 2009.

Achieve—Fit for Every Body "Spirit MR100 Rehabilitation Recumbent Bike" (Date Unknown).

Sports/Art "Recumbent Cycle C521M" (GoSportsArt.com) (Date Unknown).

* cited by examiner

ATTACHABLE ROTARY RANGE OF MOTION REHABILITATION APPARATUS

This application is based upon U.S. Provisional Application Ser. No. 62/244,190 filed Oct. 21, 2015, the complete disclosure of which is hereby expressly incorporated by this reference.

FIELD OF THE INVENTION

The present invention relates to an exercise and rehabilitation apparatus and more specifically to a rotary range of motion apparatus providing selective adjustment of the range of motion of a user's extremities, including either arms or legs, actively, assisted actively, or passively participating in a cycling action.

BACKGROUND

There have been many advancements in the area of rehabilitation apparatus for range of motion. Efforts have included inventions as described in U.S. Pat. No. 7,226,394 (Johnson) and U.S. Pat. No. 7,594,879 (Johnson), the disclosures which are hereby expressly incorporated by reference. Although these devices have helped many people with their rehabilitation, they also have certain limitations.

One problem with existing devices is that in order to change the pedal position, a physical therapist, assistant, or a patient has to remove/unstrap one or both limbs from the pedals of the device, and then put the affected limb back into or onto the pedals to again start using the device. This delays the treatment session, requires care for the affected limb while changing settings on the apparatus, and wastes an already limited amount of time that many people in recovery have with the device and the physical therapist.

Further, some existing devices comprise an entire cycling unit which cannot be retrofitted or used with to other cycle ergometers. Some of these devices are large and heavy cycles that are difficult to move and/or use outside of a clinical setting. Still further, some devices cannot be easily disassembled for cleaning as needed in certain clinical settings, due to the complexity and makeup of the parts required.

Therefore, there is a need for an apparatus providing selective adjustment of the range of motion of a user's extremities, including either arms or legs, actively, assisted-actively, or passively engaging in or participating in a cycling action, that does not have the problems associated with the prior art.

SUMMARY

One aspect of the invention includes an exercise and rehabilitation apparatus for exercising the extremity of a user wherein the position of the lever (pedal or handle) is adjustable. The apparatus includes a flywheel having a first side and a second side with a channel in the flywheel first side. The channel has a top edge near the planer surface of the flywheel first side. A lever, such as a pedal or handle, is combined with an adjustment member. The adjustment member is movable within the channel between a first position and a second position, however, the adjustment member cannot be removed from the channel through the slot/opening along its top edge. In other words, it cannot be removed from the channel in a direction that is perpendicular to the length of the channel. The adjustment member can only be removed from the channel through one of the channel openings, which have a larger width than the slot along the top edge and are positioned at the ends of the channel in some embodiments. A locking pin is combined with the adjustment member and movable between an extended position and a retracted position, the locking pin is biased in its extended position. The flywheel includes a plurality of openings adapted to receive the locking pin when the locking pin is in its extended/locked position to secure the adjustment member at a particular location within the channel. The user can retract the locking pin and move the adjustment member/lever to various desired positions along the channel.

Some embodiments include adjustment means on the second side of the flywheel for selectively adjusting the position of a second lever extending from the second side of the flywheel. In some embodiments, the adjustment means on the second side is the same as described above for the first side of the flywheel. Some embodiments include more than one channel on the first side of the flywheel to adjust the angle between the two pedals. In these embodiments the user can insert the adjustment member into any desired channel then retracted the locking pin to move the adjustment member/lever within that channel along the radius of the flywheel. The levers on either side of the flywheel can be positioned at the same or different angles and/or radius. In some embodiments the first lever is positioned at an angle that is 0, 90, 180, and 270 degrees relative to the second lever wherein 0 degrees means the levers on positioned in mirror image locations on either side of the flywheel. Each lever may also be moved to different positions along the radius of the flywheel. A pedal positioned at a larger radius (closer to the outer rim) of the flywheel requires a larger range of motion for the user's limb and a pedal positioned at a smaller radius (closer to the center) of the flywheel requires a smaller range of motion for the user's limb. Thus, a patient's "good" leg may be positioned at a larger radius on a first side of the flywheel than the patient's "bad" leg on the second side of the flywheel.

In some embodiments the flywheel can be combined with an existing cycle as an intermediate member between the cycle's existing flywheel and the adjust member member/levers. This allows the flywheel of the present invention to provide the adjustment features described herein to existing devices which did not previously have those adjustment features.

Another aspect of the invention includes a method for adjusting the position of the levers (pedals or handles) of an exercise and rehabilitation device. The method includes inserting an adjustment member into a channel on a first side of the flywheel that is combined with the rehabilitation device, wherein the adjustment member is combined with a lever. Actuating the release mechanism to retract the locking pin then sliding the adjustment member to a desired location on the first side of the flywheel. Next, a second lever is inserted into a channel on a second side of the flywheel. Its release mechanism is actuated to retract the locking pin then the second lever is moved to its desired position. The first lever and the second lever may be angularly offset from each other so that they extend from the same or from different axis on either side of the flywheel. In embodiments where an existing machine is being retrofit with the device, the pedals are removed from the existing machine and the flywheel is combined with the machine's shaft.

One advantage of the apparatus is the capability of simulating various gaits that a patient may encounter. Different gaits, such as, for example, stairs, smooth to carpeted or uneven surfaces and gaits with varying stride lengths can be simulated using different lever positions on the apparatus. These different simulated gaits can help the patient avoid further injuries by making sure that the one or more than one affected extremity is able to cope with those situations in a safe environment prior to encountering them in the real world. As mentioned above, the apparatus can be set to have different angles between the two pedals. In one embodiment, the apparatus can be set for a 90 degree angle offset position pedaling, known as LEADING LEG TECHNOLOGY, where the first pedal is offset 90 degrees from the second pedal. This position is used to rehabilitate advanced gaits and motions, including ascending or descending stairs, stepping onto or over a curb, taking a diagonal step, and walking on uneven surfaces such as grass. In these types of everyday motions, patients usually lead with their "good leg" while the affected leg is trailing. These motions are slightly different from walking in straight lines on level, even surfaces, and require a different order of muscle recruitment. The offset protocol, and apparatus settings, rehabilitates these more advanced motions, improving patient mobility, functionality, and independence. The adjustment member/pedal on the good leg would be in a channel that is 90 degrees ahead of and the adjustment member/pedal for the affected leg side.

BRIEF DESCRIPTION OF THE DRAWINGS

These and other features, aspects and advantages of the present invention will become better understood with regard to the following description, appended claims, and accompanying figures where:

DETAILED DESCRIPTION

The present invention relates to a rotary range of motion exercise and rehabilitation apparatus which provides selective adjustment of the lever(s) 12*a*, 12*b*. The levers 12*a*, 12*b* may be handles for rehabilitating arms or pedals for rehabilitating legs 17. The lever(s) 12*a*, 12*b* are operatively slidable within a channel 18 on a flywheel 14 between a first radius and a second radius, thereby affecting the range of motion of a user's extremities, including either arms or legs 17, actively, assisted-actively, or passively engaging in or participating in a cycling action. In some embodiments the apparatus may be retrofit onto an existing cycle machine.

Devices that implement the embodiments of the various features of the invention will now be described with reference to the drawings. The drawings and the associated descriptions are provided to illustrate embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

As used in this disclosure, except where the context requires otherwise, the term "comprise" and variations of the term, such as "comprising", "comprises" and "comprised" are not intended to exclude other additives, components, integers or steps.

In the following description, specific details are given to provide a thorough understanding of the embodiments. However, it will be understood by one of ordinary skill in the art that the embodiments may be practiced without these specific detail. Well-known structures and techniques may not be shown in detail in order not to obscure the embodiments with unnecessary detail.

Various embodiments provide an apparatus having selective adjustment of the range of motion of a user's extremities, including either arms or legs 17, actively, assisted-actively, or passively engaging in a cycling action. One embodiment of the present invention provides an apparatus having selective adjustment of the range of motion of a user's extremities, including either arms or legs 17, actively engaging in or passively participating in a cycling action.

Figure 1:
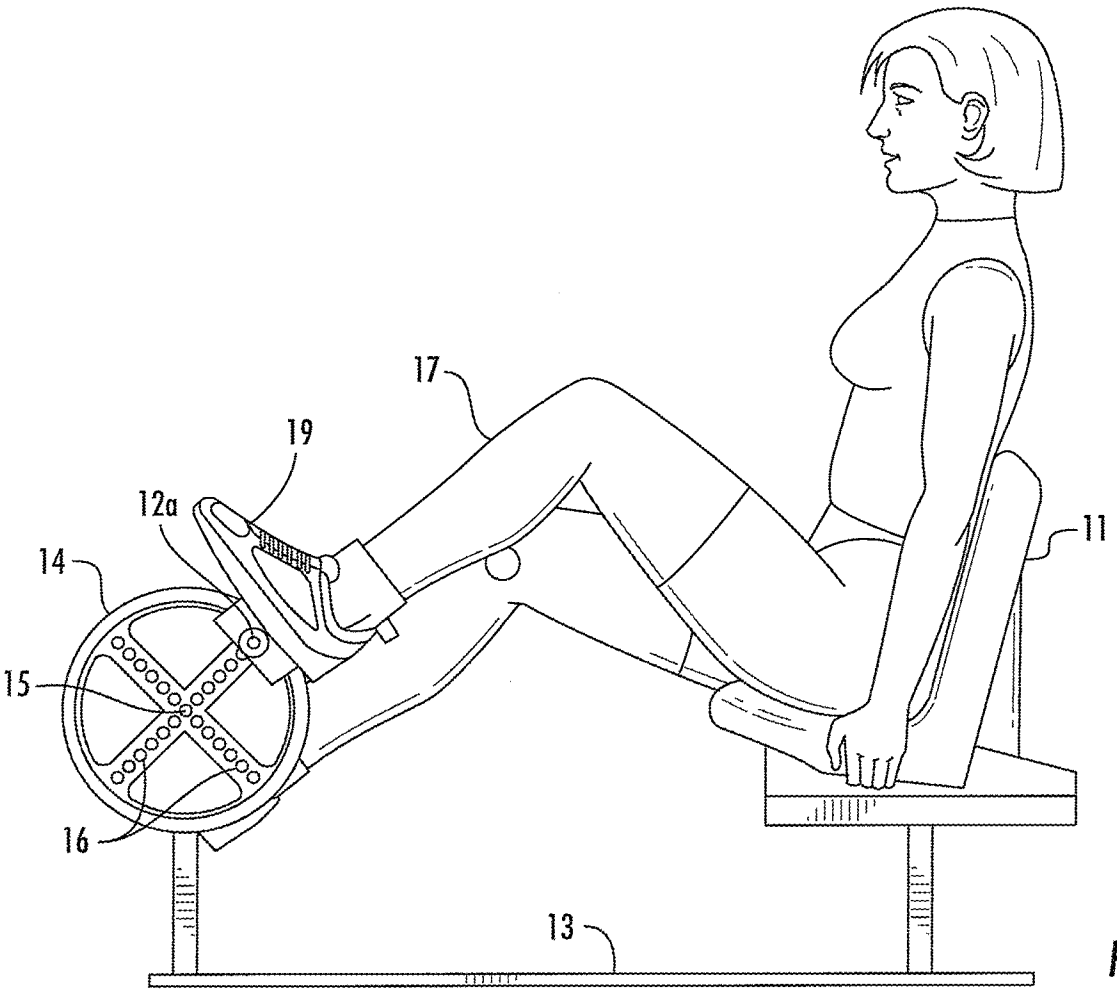
FIG. 1 is a side view of an attachable rotary range of motion exercise and rehabilitation apparatus providing selective adjustment of the range of motion of a user's extremities.

FIG. 1 shows an exemplary rotary exercise and rehabilitation apparatus providing for the selection of a range of motion for a user's arms or legs 17. The rotary rehabilitation apparatus is shown incorporated in a cycle-type exercise machine having a support 13 with a flywheel 14 rotatably mounted on one end and a seat 11 positioned at a distance from the support 13. In this arrangement, the person can sit in the seat 11, place their feet 19 on the pedals/levers 12*a* and 12*b* and impart a pushing force thereto with their legs 17 to rotate the flywheel 14 around an axis extending in the horizontal plane.

Figure 2:
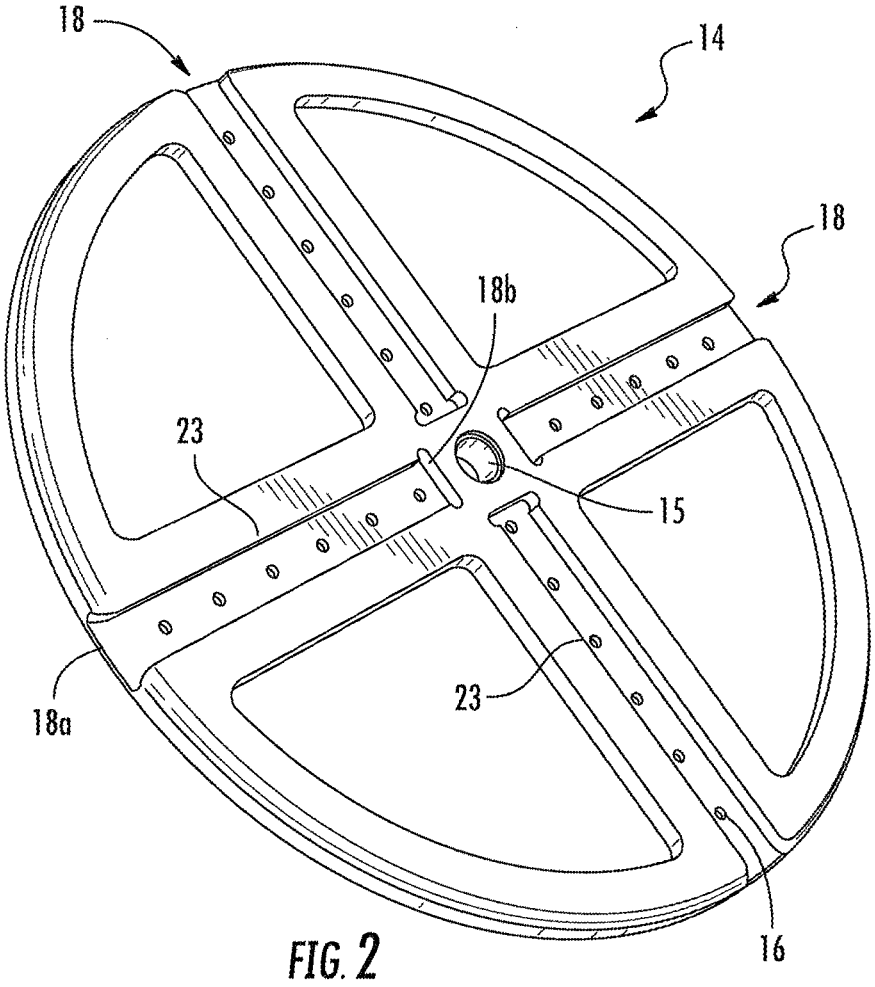
FIG. 2 is a perspective view of a first side of a flywheel of the apparatus.
Figure 3A:
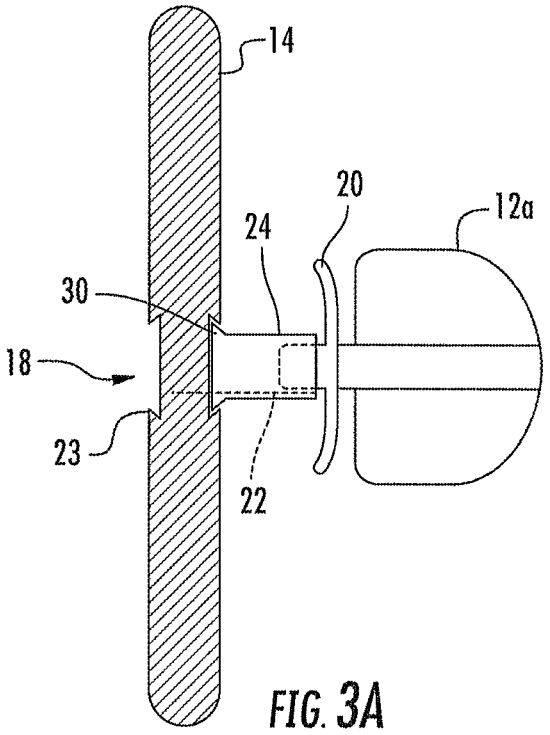
FIG. 3A is a section view of the flywheel showing an adjustment member received by the channel and the locking pin engaged.
Figure 3B:
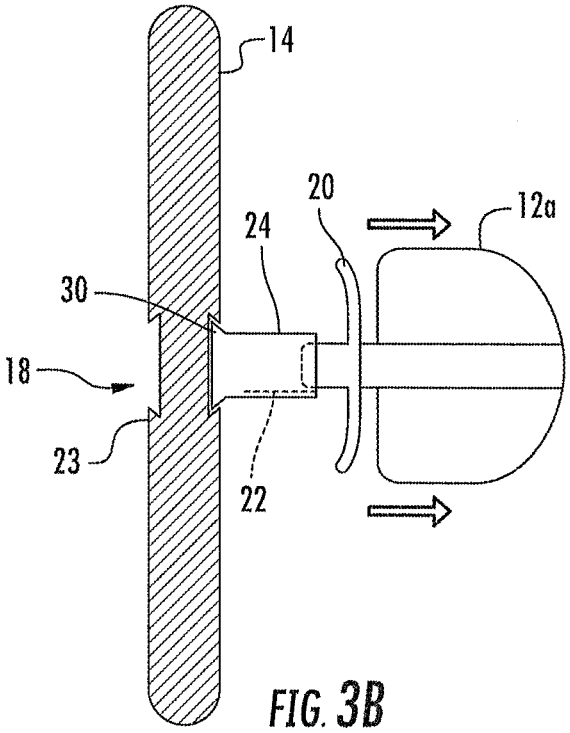
FIG. 3B is a section view of the flywheel showing an adjustment member received by the channel and the locking pin retracted.
Figure 4:
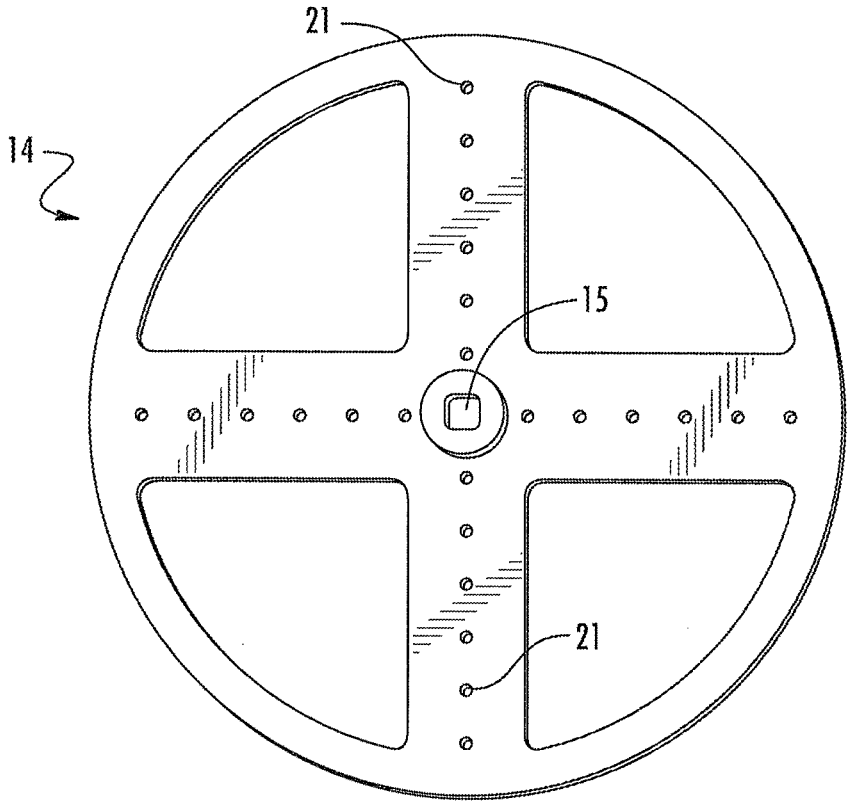
FIG. 4 is a side view showing a second side of the flywheel.

FIG. 2 shows more detail of the flywheel 14. The flywheel 14 comprises a circular disk having a perimeter edge and opposing first and second sides, each side having a generally planar surface. In other embodiments, the flywheel 14 may be oval, square, or any other suitable shape. Each of the planer surfaces is adapted to combine with a lever 12*a*, 12*b*. In some embodiments the first and second sides of the flywheel 14 are combined to form one unitary flywheel 14 (see FIGS. 3A, 3B, and 10). In other embodiments the first and second sides of the flywheel 14 are separately combined with a portion of the apparatus (see FIGS. 8 and 9) so that applying force to one lever 12*a* on one of the sides causes the lever 12*b* on the other surface to rotate. In this embodiment the first and second sides of the flywheel 14 become separate yet identical flywheels 14 positioned on either side of a cycle device, each flywheel 14 having a first side as shown in FIG. 2 and a second side as shown in FIG. 4. In either embodiment, the flywheel 14 may be combined with an existing cycle machine by any suitable means. In one embodiment the flywheel 14 includes an opening 15 near the center adapted to receive a shaft from the existing cycle machine. The shaft from the existing machine may be the shaft which is normally combined with the crank shaft of the pedal. Removing the existing pedal exposes the crank shaft and allows the flywheel 14 to be combined with the shaft so that rotation of the flywheel 14 causes rotation of the shaft.

As shown in FIG. 2, at least one side the flywheel 14 includes one or more channels 18 adapted to receive an adjustment member 24 which is adapted to slide and remain within the channel 18 similar to a sliding dovetail. The levers 12*a*, 12*b* are combined with the adjustment member 24 so that movement of the adjustment member 24 within the channel 18 also changes the position of the levers 12*a*, 12*b* along the radius of the flywheel 14.

The flywheel 14 further comprises openings 16 adapted to receive a locking pin 22 which secures the attachment member 24 at a particular location. The locking pin 22 has a locked position and a retracted position. The locking pin 22 is biased in its locked position by a spring or any other suitable means. The locking pin 22 is combined with a release mechanism 20 such as a handle so that movement of the release mechanism 20 moves the locking pin 22. The release mechanism 20 may be combined with the attachment member 24 and/or the lever 12*a*, 12*b* by any suitable means, including being slidably combined with the shaft of the lever 12*a*, 12*b*. The locking pin 22 extends through an opening 28 in the locking member 24 and into an opening 16 in the flywheel in its locked position to secure the locking member 24 at a particular location. As shown in FIGS. 3A and 3B and explained below in more detail, retracting the release mechanism 20 causes the locking pin 22 to move to its retracted position out of the opening 16 in the flywheel thereby allowing the locking member 22 to move within the channel 18. This configuration allows a patient or a therapist to adjust the lever 12*a*, 12*b* quickly and secure the lever 12*a*, 12*b* into a new position without the need to remove/unstrap the patients extremity from the lever 12*a*, 12*b* or any medical device attached to the lever 12*a*, 12*b* such as, for example an immobilization boot. However, as will be understood by those with skill in the art with reference to this disclosure, other slidable and securing mechanisms can be used in place of the channel 18 and openings 16. For example, a channel comprising dual saw-tooth edges with a reciprocal saw-tooth securing mechanism can be used to provide more granular adjustments of the lever 12*a*, 12*b*. The example provided is not meant to be limiting and other sliding and securing devices are contemplated.

Figure 7:
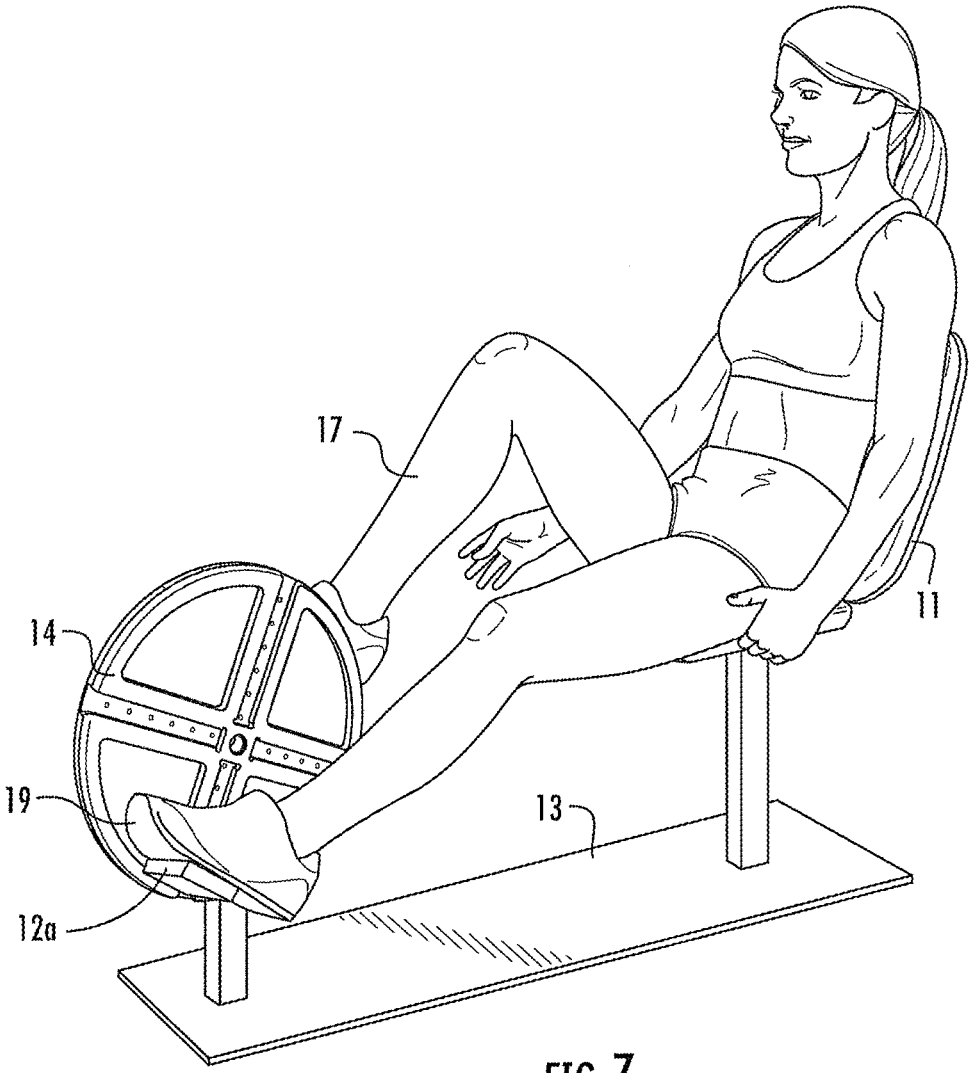
FIG. 7 is a perspective view showing normal motion for the user where the pedals are positioned 180 degrees from each other on either side of the flywheel.
Figure 10:
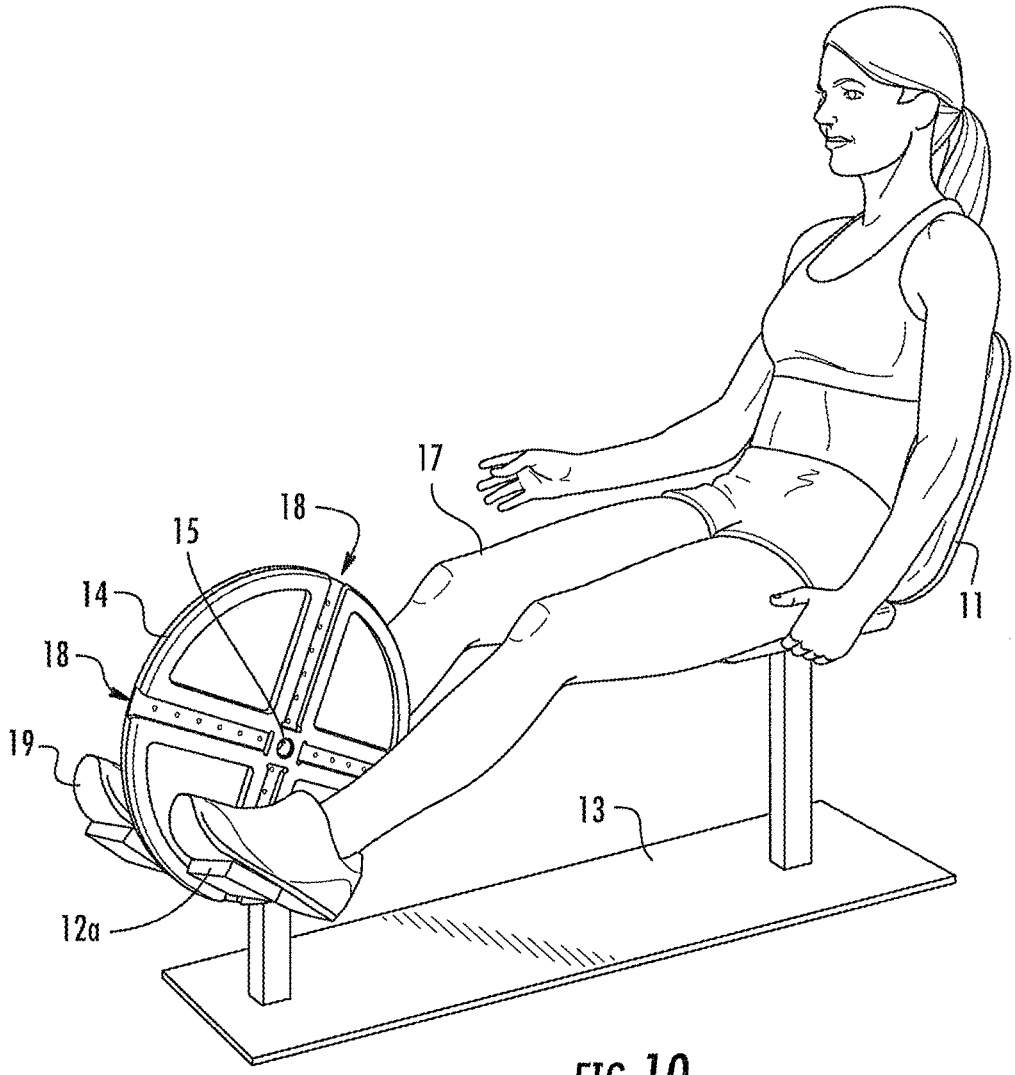
FIG. 10 is a perspective view showing an exemplary position for a sit-to-stand range of motion session where the pedals are positioned 0 degrees from each other on either side of the flywheel.

In the embodiment shown in FIG. 2, the flywheel 14 has four channels 18 on the first side of the flywheel 14 arranged in quadrants 90 degrees to one another. Each channel 18 begins near the center of the flywheel 14 and extends toward the outer edge. Any other suitable channel 18 configuration may also be used. As previously described, the adjustment member 24 is combined with the flywheel 14 to allow for adjustment along the flywheel 14 radius towards or away from the center point 15 by sliding the adjustment member 24 in a first channel 18. The position of the levers 12*a*, 12*b* is also adjustable concentrically on the flywheel 14 around the center point 15 by removing the adjustment member 24 from the first channel 18 and inserting the adjustment member 24 in one of the other channels 18. The concentric adjustment allows the levers 12*a*, 12*b* to be at an offset angle relative to each other about the flywheel 14 axis of rotation at 0, 90, 180 or 270 degrees. FIG. 7 shows the levers 12*a*, 12*b* positioned at a 180 degree angle. FIG. 10 shows the levers 12*a*, 12*b* positioned at a zero degree angle so that they are mirror images of each other on either side of the flywheel 14. Other angular offsets may be obtained by using other channel configurations in the flywheel 14. Further, other angular offsets may be obtained by combining the flywheel 14 first side to the cycle at a position that is offset from the flywheel 14 second side. In other words, an angular offset can be obtained if the channels 18 in the flywheel 14 first side are not aligned with the channels 18 on the flywheel 14 second side even if each side of the flywheel 14 only has one channel 18.

The combination of the opening 16 diameter and the size of the spring-loaded locking pin 22 release must meet medical device requirements to hold a minimum of 730 lbs (331 Kg) of patient weight in some embodiments. For morbidly obese patients, the apparatus can be changed on any device to a different apparatus that can release mechanism greater weight requirement without purchasing an entire new machine. The spring-loaded locking pin 22 release allows the adjustment member's 24 position to be changed quickly without moving the injured extremity from the apparatus, producing faster and safer movement of the limb towards the goals of improved range of motion and function.

FIGS. 3A and 3B show a section view of an exemplary flywheel 14 having a channel 18 in the first side and the second side. The channel 18, or comparable mechanism, is designed to keep the adjustment member 24 secured to the flywheel 14 (within the channel 18) even as the position of the levers 12*a*, 12*b* is adjusted. Each channel 18 has at least one channel opening 18*a*, 18*b* for receiving the adjustment member 24. The channel opening 18*a*, 18*b* has a diameter large enough to allow the flange 30 of the adjustment member 24 to be inserted into and removed from the channel 18. The embodiment shown in FIG. 2 has two channel openings 18*a*, 18*b*, one on each end of the channel 18. Once inserted into a channel 18, the adjustment member 24 cannot be removed from the flywheel 14 by exerting a force perpendicular to the length of the channel 18 because the slot along the top edge 23 is narrower than the adjustment member's 24 flange 30.

The channel 18 has a tapered wall to help secure the adjustment member 24 in the channel 18. In one embodiment the channel 18 has first width that is wider than a second width. The first width is farther from the top edge 23 of the channel 18 than the second width so that the channel 18 becomes narrower toward the top edge 23. This creates a lip or flange near the channel's 18 top edge 23. The adjustment member 24 includes a flange 30 which is wider than the second width of the channel 18 but not wider than the first width of the channel 18. This allows the adjustment member 24 to slide within the channel 18, but not be removed through the slot along the channel's 18 top edge 23 by applying force in the direction of the arrows shown in FIG. 3B. In some embodiments the channel 18 includes a cambered edge that is used to secure the adjustment member 24 to the flywheel 14.

FIG. 4 shows an embodiment where the second side of the flywheel 14 does not have a channel 18. This embodiment allows the flywheel 14 to be easily retrofitted onto any cycle ergometer as shown, for example, in FIG. 8. As described above, in this embodiment the flywheel 14 first side and the flywheel 14 second side may be two separate members, each having a first side as shown in FIG. 2 and a second side as shown in FIG. 4. Each flywheel 14 is combined with one side of a cycle device. In another embodiment the second side (FIG. 4) includes a plurality of openings 21 adapted to combine with a lever 12*b* but does not include a channel 18. The openings 21 are positioned to be generally a mirror image of the openings 16 in the first side of the flywheel 14 to allow for proper alignment of the levers 12*a*, 12*b*. The lever 12*b* extending from the second side of the flywheel 14 may also be combined with the center point 15 of the second side of the flywheel 14 by a crank as described in U.S. Pat. No. 7,226,394 (Johnson).

Figure 5A:
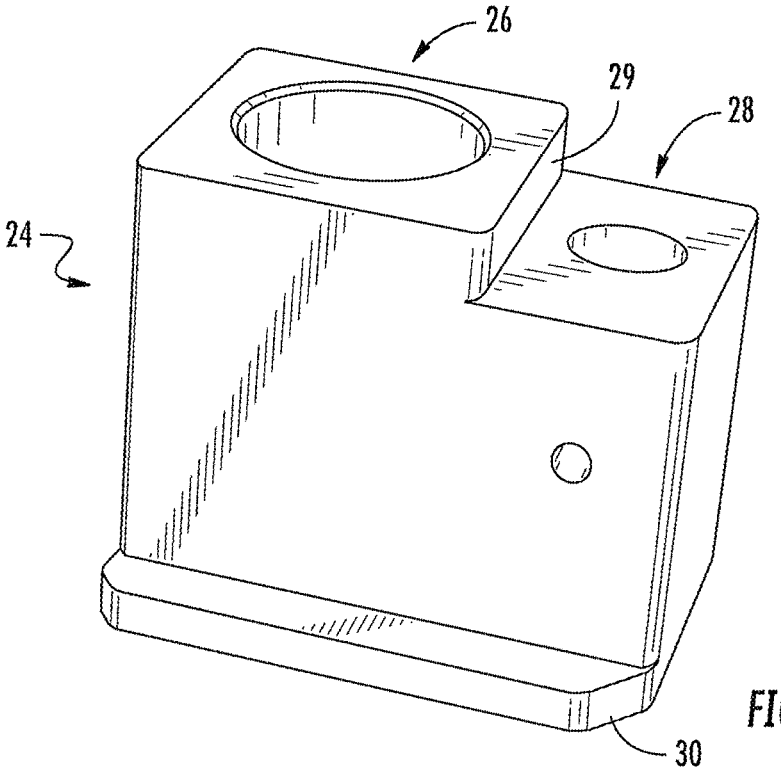
FIG. 5A is a perspective view of the adjustment member.
Figure 5B:
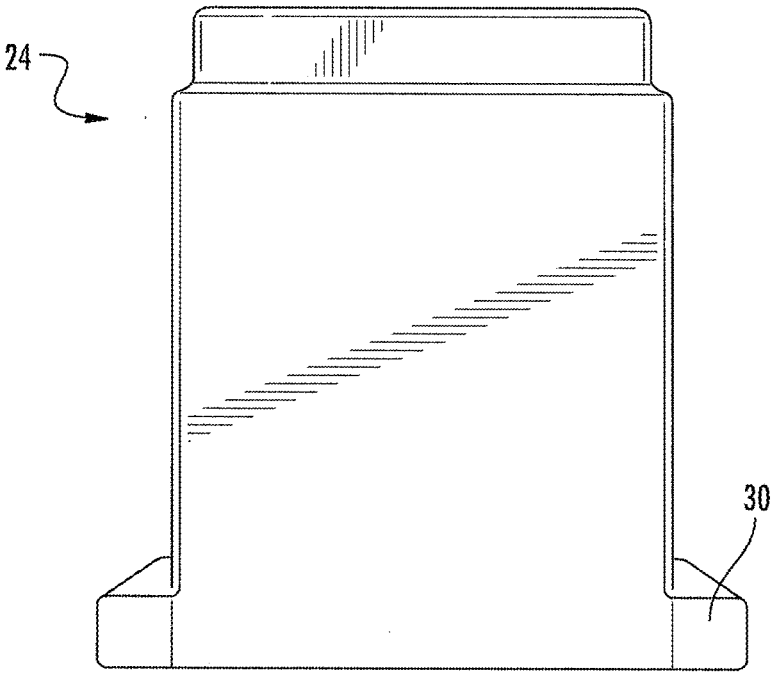
FIG. 5B is a side view of the adjustment member.
Figure 6:
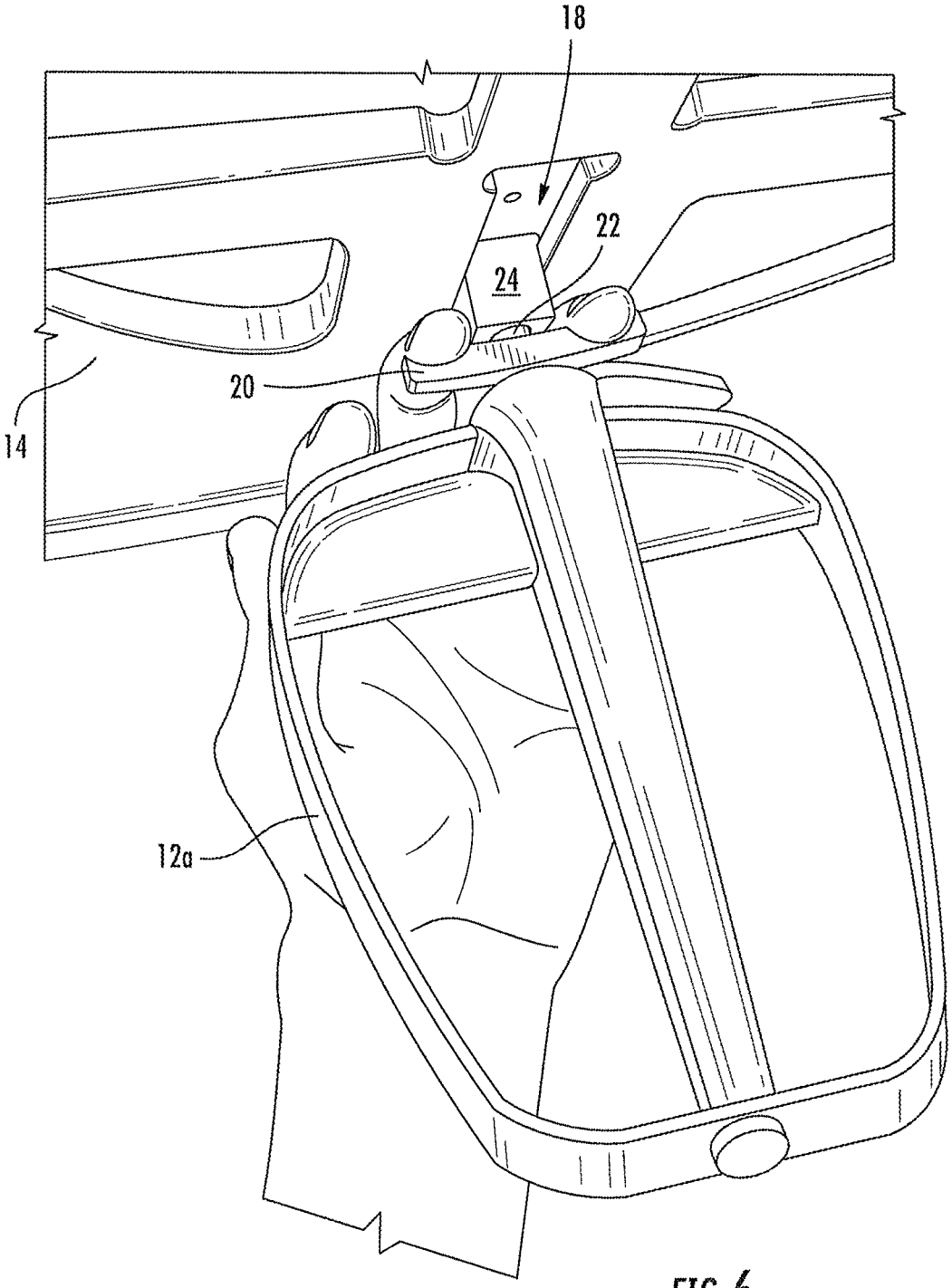
FIG. 6 is a perspective view showing a user pulling on the release mechanism to move the locking pin to its retracted position.

FIGS. 5A and 5B show an exemplary adjustment member 24 having one or more ridges or flanges 30 adapted to be received into the channel 18 beneath the slot/edge 23 of the channel 18. A first opening 26 is adapted to combine with a lever 12*a*, 12*b* and/or release mechanism 20 by any suitable means. In one embodiment the first opening 26 is threaded to allow the threaded shaft of a lever 12*a*, 12*b* to be screwed into the opening 26. The adjustment member 24 on one side of the flywheel 14 may be reverse threaded as is know in the cycling industry. A second opening 28 in the adjustment member 24 is adapted to receive at least a portion of the locking pin 22. The locking pin 22 is combined with the release mechanism 20 and extends through the second opening 28 and into the openings 16 in the flywheel 14 in its locked position. FIG. 6 shows a user moving the release mechanism 20 in the direction of the arrows in FIG. 3B to retract the locking pin 22 from the opening 16 in the flywheel 14 and allow movement of the adjustment member 24 within the channel 18. While the release mechanism 20 is in the raised position the lever 12*a*/adjustment member 24 can be adjusted along the radius of the flywheel 14 without removing the patient's extremity from the lever 12*a*, 12*b*. This saves time and effort as the release mechanism 20 is configured to reduce the amount of force or leverage that is required to activate the securing pin 22. Additionally the movement of the patient's extremity can be accomplished in a smoother and less disruptive manner than was possible in the prior art. As will be understood by those with skill in the art with reference to this disclosure, there are a variety of different configurations for the lever 20 which are available to be used and this is but one example of many that are contemplated by the inventor.

Figure 5C:
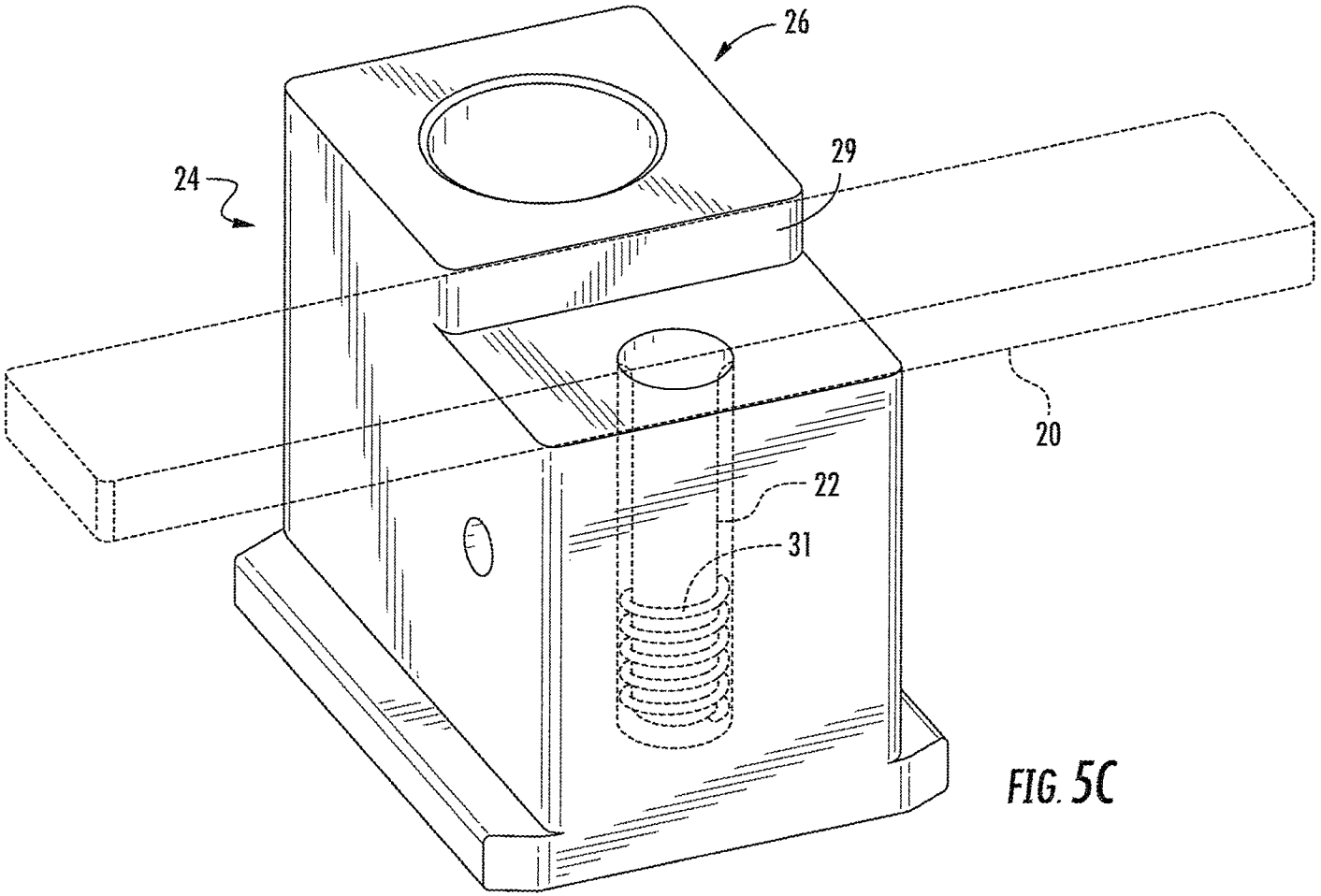
FIG. 5C is a perspective view of the adjustment member engaged with a release mechanism.

In one embodiment, a stepped ridge is located between the first opening 26 and the second opening 28 to provide a surface around the first opening 26 that is higher than a surface around the second opening 28. The stepped ridge helps secure the spring-loaded pin 22 from moving while the apparatus is in use. It is an added safety measure to insure that the adjustment member 24 stays in the set position without slipping. As shown in FIG. 5C, the release mechanism 20 is biased toward the adjustment member 24 so one of its surfaces engages the lower surface around the second opening 28 and another one of its surfaces engages the stepped vertical surface 29 when the pin 22 is in its locked position. The vertical surface 29 helps keep the release mechanism 20 from moving or spinning to a position where it could be accidently kicked or released by the user.

In one embodiment the adjustment member 24 is made of any material that can pass the industry standard ISO 20957-1:2005 weight test when inserted into the channel 18 on the flywheel 14. Preferably, the adjustment member 24 can take a minimum of 730 lbs (331 Kg). The adjustment member 24 and the corresponding channel 18 can be widened or made thicker as needed to accommodate heavier patients or more rigorous training.

Depending on the functionality desired in the cycle-type exercise machine, the flywheel 14 can be designed to have a relatively large or small moment of inertia. A large moment of inertia flywheel 14 requires more peddling force to accelerate the same to a given speed, but also causes the flywheel 14 to better resist changes in speed, resulting in smoother "steady-state" cycling, which may be preferred in certain rehabilitation exercises. The higher moment of inertia is created by making the flywheel 14 heavier and/or moving more of the flywheel weight out to the circumferential ring 30.

In addition to controlling the moment of inertia in the flywheel 14, the overall resistance to turning of the flywheel 14 may be controlled to increase the amount of work a user must perform in peddling, as those of skill in the art appreciate with respect to known cycle-type exercise machines. For example, frictional resistance may be incorporated in to the design to require a certain amount of force to overcome the static and dynamic friction to turn the flywheel 14. Alternatively, a frictional surface (not shown), for example, a brake, may selectively engage the flywheel 14 to create static and dynamic friction.

In one embodiment, portions of the apparatus are made from any material capable of passing industry standard weight tests described in ISO 20957-1:2005 for stationary training equipment. The apparatus can withstand at least a minimum of 1.82 times 401 lbs. (182 kg) or 730 lbs (331 Kg) of force. The material may be aluminum.

A central opening 15 in the disk can be sized to be retrofitted onto any cycle ergometers device converting the cycle ergometers into a therapeutic range of motion device. This is a vast improvement over the prior art, where many devices are single purpose and are relatively expensive. The claimed apparatus provides greater flexibility and cost savings to patients, hospitals and other therapy locations. It also allows for portable devices to be created that can be taken to the patient's home by a therapist for in home therapy or purchased by the patient at a much reduced cost than was available in the prior art. Additionally, the apparatus can be fully cleaned when removed from the cycle ergometer, which can be a requirement not attainable with current single purpose devices.

Optionally, a quick release mechanism can also be attached to the flywheel 14 to attach and remove the apparatus from a third-party cycle ergometer. This allows the apparatus to be portable between cycle ergometers at different locations or even at the same location depending upon a physician prescribed routine and the needs of the patient.

In some embodiments the first and second side of the flywheel 14 includes position indicators marking the channels 18 and openings 16, 21. The indicators on a dual apparatus setup, where there is one flywheel 14 on each side of the cycle ergometer (FIG. 8), are different for the left side and the right side. This is so that one or more than one adjustment member 24 can be located in the proper position quickly. Additionally, the indicators on each flywheel 14 can be recorded in a therapy or training log for use by the physician or the therapist. The indicators can also be used during training to measure progress as the adjustment member 24 is moved throughout the session.

Referring now to FIG. 7, a user is using the apparatus under normal motion where each lever 12*a*, 12*b* is located near opposing outer edges (180 degrees from each other) on either side of the flywheel 14. An uninjured, or fully recovered, patient can operate the apparatus in a normal cyclical motion. This is the final goal of most therapies. Once the patient can successfully perform this motion, additional resistance can be introduced through the apparatus to begin strength training of the patient.

Figure 8:
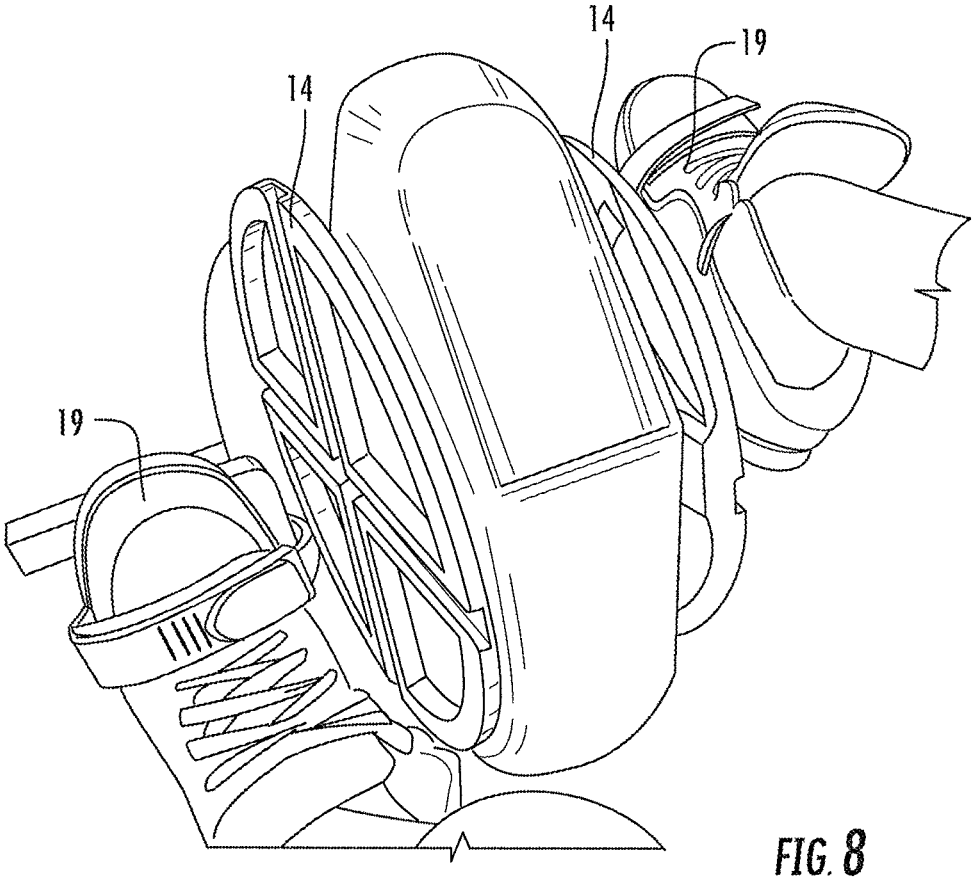
FIG. 8 is a perspective view showing normal motion for the user wherein the flywheel is separated into two separate members.

Referring now to FIG. 8, there is shown an image of a patient using the apparatus wherein two separate flywheel 14 components are used, one on each side of the device. As can be seen, the apparatus has been attached to an existing third party cycle ergometer. The cycle ergometer still maintains all of its original capabilities, but it has been enhanced with the addition of the apparatus. Also seen is the patient's affected extremity strapped to the pedal adapter in a medical device. Because of this injury to the patient, removing the affected extremity from the medical device and resetting the pedal adapter would be a time consuming and wasteful effort that is eliminated with the apparatus as described above. The patient received the maximum amount of therapy in the time allotted which will speed the patient's recovery, freeing needed resources for other patients.

Figure 9:
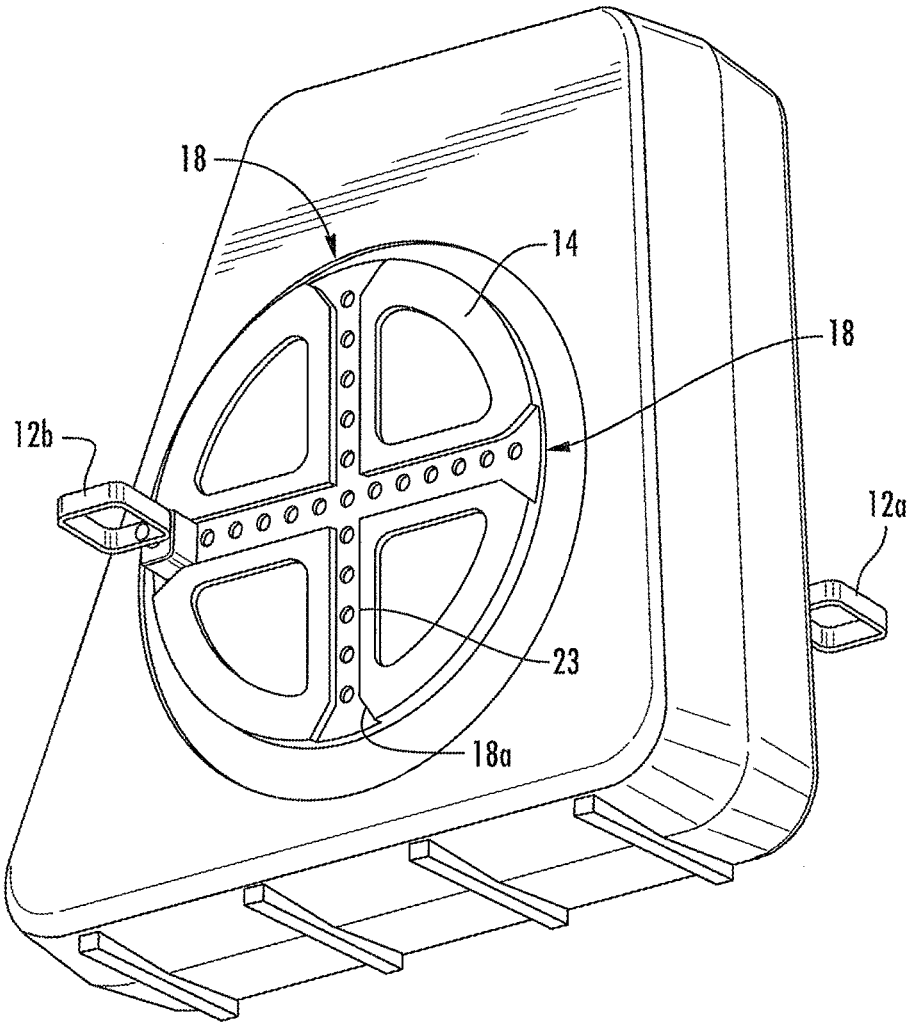
FIG. 9 is a perspective view showing an embodiment where the apparatus is portable.

FIG. 9 shows a portable unit with a dual apparatus setup that can combine range of motion and resistance in a small portable package. This embodiment does not include a seat 11 or a support 13. The cost is significantly lower for the portable cycle ergometer. Hospitals can have therapy begun much earlier in the patient's room, or it can be used to prepare the affected extremity prior to surgery. Traveling physical therapists can easily take the portable cycle ergometer to a patient's residence to continue therapy after being released from the hospital. Patients with long term needs can afford to purchase the portable cycle ergometer due to the much lower price than a standard, bulky cycle ergometer.

FIG. 10 shows a patient using the device with both levers 12*a*, 12*b* positioned at the same location (zero degrees from each other) on opposite sides of the flywheel 14. In this manner, both legs are pushing or pulling at the same time to simulate a sit-to-stand range of motion session. As the patient's recovery progresses, additional resistance can be added to the apparatus, as will be understood by those with skill in the art, so that the patient will be able to get up from a chair or sitting position lifting their upper body weight.

What has been described is a new and improved apparatus providing selective adjustment of the range of motion of a user's extremities, including either arms or legs, actively, assisted-actively, or passively engaging in a cycling action, overcoming the limitations and disadvantages inherent in the related art. Patients need to be able to use a rehabilitation device within a myriad of diagnoses or settings for the product to be cost effective for hospital, physical therapy clinic, skilled facility, or home use. For example, a patient requiring a bandage post operatively with an associated incisional wound would not necessarily be cleared to use a pool. A patient with an external fixation or intricate bandage for a wound or burn may be unable to utilize a continuous passive motion (CPM) machine without the potential for additional risk. Inpatient or outpatient use of an apparatus would be necessary, in patients young or old, with work injuries to arthritis to neurologic abnormalities, burns, morbid obesity, etc. for continued rehabilitation following the initiation of rehab from the Orthopedic, Surgical, Medical, Emergency, or other clinical settings upon discharge.

A hospital or other facility that can use the device across many diagnoses and clinical settings is a significant budgetary factor in determining cost effectiveness. Additionally, male or female participants, with varying hand sizes and levels of strength, varying levels of knowledge and interventional skill, or manipulative abilities to due arthritis or age, etc. must be able to easily recognize how to use the apparatus in a clinical or home setting, or it will not be utilized. The present invention overcomes all the limitations of the prior art in a cost effective manner.

Although the present invention has been described with a degree of particularity, it is understood that the present disclosure has been made by way of example and that other versions are possible. As various changes could be made in the above description without departing from the scope of the invention, it is intended that all matter contained in the above description or shown in the accompanying drawings shall be illustrative and not used in a limiting sense. The spirit and scope of the appended claims should not be limited to the description of the preferred versions contained in this disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An apparatus combinable with an exercise cycle machine for providing an adjustable range of motion, the apparatus comprising:

a flywheel having a first side and a second side;

a channel in the flywheel first side, said channel having a slot along a top edge;

an adjustment member combined with a first lever, said adjustment member movable within in the channel between a first position and a second position;

wherein the first lever is one of a pedal or handle for engaging with a user's limb for exercise;

wherein the adjustment member includes a flange that is wider than a width of the slot and the flange is slidable within the channel.

2. The apparatus of claim 1 further comprising:

a locking pin combined with the adjustment member and movable between an extended position and a retracted position, said locking pin biased in the extended position;

a first plurality of openings in the flywheel first side adapted to receive the locking pin and secure the adjustment member when the locking pin is in the extended position.

3. The apparatus of claim 2 wherein the adjustment member includes a first opening for combining with the first lever and a second opening adapted to receive the locking pin.

4. The apparatus of claim 2 wherein the flywheel second side has a second plurality of openings corresponding to the first plurality of openings in the flywheel first side.

5. The apparatus of claim 1 wherein the flywheel second side includes a second channel adapted to receive a second adjustment member.

6. The apparatus of claim 1 wherein the flywheel first side and the flywheel second side are combined to form a unitary member.

7. The apparatus of claim 1 wherein the flywheel first side and the flywheel second side are two separate disk members.

8. The apparatus of claim 1 wherein the flywheel first side includes four channels spaced 90 degrees apart from each other.

9. The apparatus of claim 1 wherein the flywheel second side is combined with a second lever positioned at an angle of at least one of 0 degrees and 90 degrees from the first lever.

10. The apparatus of claim 1 wherein the channel further comprises at least one channel opening for receiving the adjustment member.

11. An apparatus combinable with an exercise cycle machine for providing an adjustable range of motion, the apparatus comprising:

a flywheel having a first side and a second side;

a channel in the flywheel first side, said channel having a slot along a top edge;

an adjustment member having a first opening adapted to combine with a first lever and a second opening adapted to receive a locking pin, said adjustment member movable within in the channel between a first position and a second position;

wherein the adjustment member includes a stepped surface between the first opening and the second opening so that a surface around the first opening is raised relative to a surface around the second opening;

wherein the channel has a tapered width that is narrower near the top edge.

12. An apparatus combinable with an exercise cycle machine for providing an adjustable range of motion, the apparatus comprising:

a flywheel having a first side and a second side;

a channel in the flywheel first side extending between a first radius and a second radius, said channel having a tapered width with a wider portion below a narrower portion;

an adjustment member combined with a first lever, said adjustment member having a flange that is wider than the channel narrower portion, said adjustment member movable within the channel between the first radius and the second radius;

a release mechanism combined with the adjustment member, the release mechanism having a locking pin movable between an extended position and a retracted position and biased in the extended position;

an opening in the flywheel at the first radius, said opening adapted to receive the locking pin and secure the adjustment member at the first radius when the locking pin is received in the opening in the extended position;

wherein the first lever is one of a pedal or handle for engaging with a user's limb for exercise.

13. The apparatus of claim 12 wherein the flywheel second side includes a second channel adapted to receive a second adjustment member.

14. The apparatus of claim 12 wherein the flywheel first side and the flywheel second side are two separate disk members.

15. An apparatus combinable with an exercise cycle machine for providing an adjustable range of motion, the apparatus comprising:

a flywheel having a first disk portion and a second disk portion, each disk portion having a first side and a second side;

a channel in the first side of each disk portion, said channel having a slot along a top edge;

an opening in each disk portion adapted to combine with a shaft of the exercise cycle machine so that the first disk portion is adapted to combine with a first side of the exercise cycle machine and the second disk portion is adapted to combine with a second side of the exercise cycle machine;

a first adjustment member having a first opening adapted to combine with a first lever and a second opening adapted to receive a first locking pin, said first adjustment member movable within in the channel on the first side of the first disk portion between a first position and a second position;

a second adjustment member having a first opening adapted to combine with a second lever and a second opening adapted to receive a second locking pin, said second adjustment member movable within in the channel on the first side of the second disk portion between a first position and a second position;

wherein the first and second locking pins are respectively combined with the first and second adjustment members and respectively movable between an extended position and a retracted position, said first and second locking pins biased in the extended position, wherein the first and second adjustment members each include a stepped surface between the first opening and the second opening so that a surface around the first opening is raised relative to a surface around the second opening;

a plurality of openings in each of in the first side of the first disk portion and the first side of the second disk portion, said plurality of openings adapted to respectively receive the first and second locking pins.

16. The apparatus of claim 15 wherein each of the first and second levers is a pedal.

17. The apparatus of claim 15 wherein the first side of the first disk portion and the first side of the second disk portion respectively include four channels spaced 90 degrees apart from each other.

18. The apparatus of claim 15 wherein the first lever is combined with a first channel on the first side of the first disk portion and the second lever is combined with a second channel on the first side of the second disk portion, and wherein the first lever is positioned at an angle of at least one of 0 degrees and 90 degrees from the second lever.

19. The apparatus of claim 15 wherein the channel in the first side of each disk portion further comprises at least one channel opening for receiving the respective adjustment member.

* * * * *